United States Patent [19]

Clough

[11] Patent Number: 4,513,015

[45] Date of Patent: Apr. 23, 1985

[54] METHOD OF SEALING A CONTAINER AND REMOVING AIR HEADSPACE

[75] Inventor: Graham Clough, Maidenhead, England

[73] Assignee: Nestec, S.A., Vevey, Switzerland

[21] Appl. No.: 347,110

[22] Filed: Feb. 9, 1982

[30] Foreign Application Priority Data

Feb. 27, 1981 [GB] United Kingdom ..... 8106326

[51] Int. Cl.[3] ..... B65B 31/00

[52] U.S. Cl. ..... 426/396; 426/397; 426/404; 426/410; 426/415; 426/418; 426/403; 53/433; 53/434

[58] Field of Search ..... 426/396, 397, 404, 410, 426/415, 418, 403; 53/432–434, 510–512

[56] References Cited

U.S. PATENT DOCUMENTS

| | | | |
|---|---|---|---|
| 2,177,919 | 10/1939 | Vogt | 53/459 |
| 2,338,012 | 12/1943 | Schmitt | 426/404 |
| 2,339,896 | 1/1944 | Waters | 426/410 |
| 2,736,656 | 2/1956 | Marshall | 426/396 |
| 2,863,267 | 12/1958 | Moore | 426/410 |
| 2,925,719 | 2/1960 | Robbins et al. | 53/434 |
| 2,942,390 | 6/1960 | Lerner | 426/396 |
| 3,085,608 | 4/1963 | Mathves | 229/DIG. 14 |
| 3,299,607 | 1/1967 | Dopp et al. | 426/404 |
| 3,351,265 | 11/1967 | Miller | 426/396 |
| 3,353,325 | 11/1967 | Jensen et al. | 206/484 |
| 3,471,990 | 10/1969 | Bonuchi | 53/434 |
| 3,561,668 | 2/1971 | Bergstrom | 426/396 |
| 3,659,393 | 5/1972 | Richter | 426/396 |
| 3,673,760 | 7/1972 | Canamero et al. | 53/433 |
| 3,695,900 | 10/1972 | Young et al. | 426/396 |
| 3,744,210 | 7/1973 | O'Lenick et al. | 53/53 |
| 3,750,362 | 8/1973 | Kishpaugh et al. | 206/525 |
| 3,776,798 | 12/1973 | Miland | 206/484 |
| 3,843,806 | 10/1974 | Kishpaugh et al. | 426/106 |
| 4,055,672 | 10/1977 | Hirsch et al. | 426/396 |
| 4,058,953 | 11/1977 | Sandborn et al. | 426/396 |
| 4,122,197 | 10/1978 | Krugmann | 426/396 |
| 4,223,512 | 9/1980 | Buchner | 426/396 |
| 4,424,659 | 1/1984 | Perigo | 53/405 |

FOREIGN PATENT DOCUMENTS

| | | | |
|---|---|---|---|
| 44871 | 12/1938 | Austria | 426/396 |
| 2539351 | 3/1977 | Fed. Rep. of Germany | 426/410 |
| 1408217 | 5/1964 | France | 426/118 |
| 647423 | 12/1950 | United Kingdom | 426/410 |

*Primary Examiner*—Steven Weinstein
*Attorney, Agent, or Firm*—Vogt & O'Donnell

[57] ABSTRACT

A process for sealing a thermoplastic based food container characterized in that after filling, the container is sealed by an intermediate membrane made of a microporous plastic gas-breathable material, gas is extracted from the headspace through the membrane and afterwards the container is sealed by a final barrier membrane.

11 Claims, 7 Drawing Figures

METHOD OF SEALING A CONTAINER AND REMOVING AIR HEADSPACE

The present invention relates to a process for sealing thermoplastic food containers in which the headspace oxygen is removed or reduced.

At the present time there are a number of factors which limit the use of thermoplastic containers in the processed food industry. For example, the shelf life of ambient temperature stored food products in thermoplastic containers is currently limited by the oxidative degradation attributed to oxygen either permeating through the body of the container or emanating from the headspace gas. In the majority of cases the headspace oxygen is the most significant cause of the oxidative degradation because the volume of the headspace exceeds the volume of gas permeating through the container during normal periods of storage. This is particularly so in the case of small containers where the headspace represents a large percentage of the total volume of the container.

There are several commonly used methods for eliminating headspace oxygen such as vacuum closing and gas flushing but these are generally slow and inefficient. Initially the headspace is evacuated, usually inside a chamber larger than the food container so that the container can be sealed with a diaphragm whilst still within the vacuum chamber. In the case of gas flushed containers, the whole chamber has to be flushed to atmospheric pressure before sealing can take place and consequently more gas is used than is necessary to fill the headspace: this process is therefore rather slow and expensive because of the high gas consumption.

In the case of applications where hot filling is required it is impossible to use the vacuum closing method because of the boiling which occurs at the reduced pressure and which causes subsequent contamination of the seal area. Therefore in hot filling applications, it is necessary to use the continuous gas flushing process which uses even more gas and is generally less efficient.

We have found, surprisingly, that by using a microporous plastic gas-breathable membrane as an intermediate lidding material before the final sealing of the container, gases can be extracted from the headspace without contamination of the seal area by the food product and without the necessity of carrying out wasteful gas flushing procedures.

Accordingly, the present invention provides a process for sealing a thermoplastic based food container characterised in that after filling, the container is sealed by an intermediate membrane made of a microporous plastic gas-breathable material, gas is extracted from the headspace through the membrane and afterwards the container is sealed by a final barrier membrane.

Preferably the container is sealed by the intermediate membrane immediately after filling.

If desired, after gas has been extracted from the headspace, inert gas may be flushed back to atmospheric pressure to the original headspace volume before the final barrier membrane is sealed to the container. The inert gas is a gas which has no detrimental effect on the food product and contains substantially no oxygen, and is preferably nitrogen or carbon dioxide. Both the intermediate membrane and the final barrier membrane may be sealed to the container by conventional means, for example by using a sealing head fitted with a sealing tool.

The container and the intermediate microporous membrane may be made of a variety of plastics materials, for example polyolefins, vinyl polymers, polyamides or polyesters. The polyolefins may be homopolymers, copolymers or filled, for example, filled polyethylene or filled polypropylene. The container and the intermediate microporous membrane may be made of dissimilar materials and, in such cases, the intermediate membrane may be provided with patterned heat seal coatings; for example, the container may be made of polyester and the intermediate microporous membrane may be made of polypropylene coated in the seal areas with a heat seal lacquer.

Desirably the intermediate microporous membrane is elastic which helps to prevent panelling of the container.

The porosity to air at atmospheric pressure of the intermediate membrane may be from 6 to 2,500 cc/min, preferably from 200 to 2,000 cc/min and specially from 1,000 to 2,000 cc/min. The pore diameter may be up to 6 mμ and preferably from 2 to 5 mμ.

The process of the present invention may be used in the following applications:

(1) Cold-filled non-processed containers;

(2) Hot-filled containers with or without subsequent pasteurisation;

(3) Cold- or hot-filled heat-processed containers.

When the product is subjected to a heat-processing treatment, this is carried out after the container has been sealed by the intermediate membrane, the porosity of which prevents excessive inflation of the container without the need for over-pressure.

The gas may be extracted from the headspace either by mechanically deforming the intermediate membrane into the headspace, thereby forcing the gas out through the membrane or by vacuum suction. If desired, both mechanical deformation of the membrane and vacuum suction may be used simultaneously to extract the gas.

The intermediate membrane permits the extraction of gases from the headspace without the risk of the product being sucked out of the container. If desired, removal of the headspace gas may take place up to the point where the intermediate membrane is in contact with the product.

Both the vacuum suction and the gas flush may be carried out by means of a suction head positioned over the container preferably with the outer rim of the head located on the container rim. This ensures a quicker and more efficient extraction and gas flush than with a conventional chamber machine.

After the extraction of gas from the headspace and, if desired, reflushing to atmospheric pressure with inert gas, the final barrier membrane is sealed to the container. This may be a conventional membrane, for example, one made of a foil laminate. In the cases where the container is gas flushed, the final appearance is similar to conventional containers, that is, with a flat foil diaphragm seal, but in the cases where sealing takes place immediately after extraction of the gas, the container has a dished or recessed appearance.

The cycle time of the process depends on such factors as the film porosity, the headspace volume, the extraction technique and the size of the container but is usually from 1 to 10 seconds.

The process of the present invention may be used on many types of container for example, polypropylene based thermoplastic pots, tubs or trays, polypropylene coated containers, foil alutray or plastic can type containers. The cross-section of the container may be one of several shapes, for example round, rectangular or oval. Food products contained in the thermoplastic containers sealed in accordance with the present invention have an improved shelf life compared with conventional containers.

BRIEF DESCRIPTION OF THE DRAWINGS

The present invention will now be further described by way of example with reference to the accompanying drawings in which.

Figure 1:
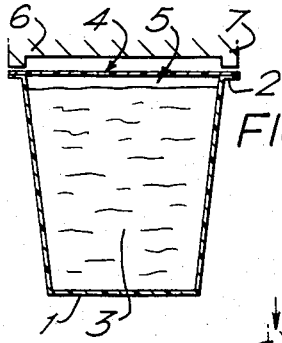
FIG. 1 is a sectional view of a filled container and the lower part of the first sealing head.
Figure 2:
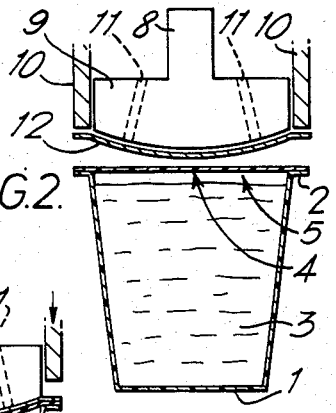
FIG. 2 is a sectional view of a filled container and a second head before descent.
Figure 3:
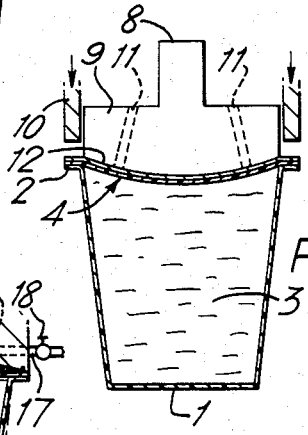
FIG. 3 is a sectional view of a filled container and the second head after descent.

One embodiment of this invention will now be described with reference to FIGS. 1 to 3.

A thermoplastic based container 1 with a rim 2 comprises a food product 3, an intermediate microporous polypropylene membrane 4 and a headspace 5. A first head 6 is fitted with a sealing tool 7. A second head 8 comprises an inner piston 9, a sealing tool 10, channels 11 and at its lower end a pre-cut formed foil membrane 12.

In operation, the container 1 is initially positioned beneath the first head 6 where the intermediate microporous polypropylene membrane 4 is sealed to the rim 2 in the conventional manner by the sealing tool 7 to confer the normal volume of headspace 5. Afterwards the first head 6 is removed and the container is brought into position beneath the second head 8 which holds the pre-cut formed foil diaphragm 12 at its lower end by means of vacuum suction through channels 11, whereupon the inner piston 9 descends to deform the intermediate membrane 4 and in so doing forces out the headspace gas until the membrane touches the food product 3. The foil membrane 12 is then sealed to the rim 2 of the container 1 by means of sealing tool 10 while still in contact with the intermediate membrane 4.

Figure 4:
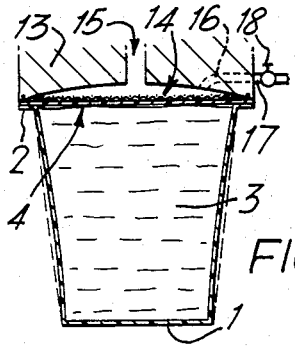
FIG. 4 is a sectional view of a filled container and a second head located on the container rim.
Figure 5:
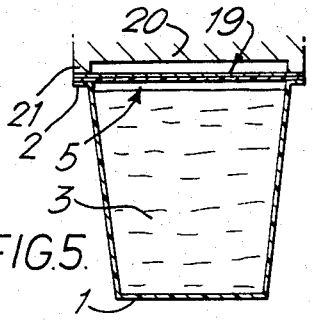
FIG. 5 is a sectional view of a filled container and the lower part of a third head after descent.

A second embodiment of this invention will now be described with reference to FIGS. 1, 4 and 5.

A thermoplastic based container 1 with a rim 2 comprises a food product 3, an intermediate microporous polypropylene membrane 4 and a headspace 5. A first head 6 is fitted with a sealing tool 7. A second head 13 is fitted with a rigid porous mesh 14, a relief valve 15 and a channel 16 to which is fitted a gas inlet pipe 17 with a tap 18.

A second foil membrane 19 lies on top of the container 1 beneath a third head 20 fitted with a sealing tool 21.

In operation, the container 1 is initially positioned beneath the first head 6 where the intermediate microporous polypropylene membrane 4 is sealed to the rim 2 in the conventional manner by the sealing tool 7 to confer the normal volume of headspace 5. Afterwards the first head is removed and the container 1 is moved to the second head 13 which is brought into a position where it is located on the rim 2 and the rigid porous mesh 14 lies immediately above the intermediate membrane 4. The gas is then extracted from the headspace by vacuum suction through the relief valve 15 and during this operation the location of the head 13 on the container rim 2 restricts the suction to the area immediately above the container 1. In addition the rigid porous mesh 14 permits the flow of the headspace gas but restricts the expansion of the intermediate membrane 4 during the vacuum suction. After the gas has been extracted from the headspace, the tap 18 is opened and nitrogen flushes into the pipe 17 through the channel 16 and enters the headspace 5, initially under vacuum but afterwards under pressure to improve the flushing efficiency, until the normal headspace volume is attained. Finally the tap 18 is closed and the container 1 is moved to the third head 20 which descends to seal the second foil membrane 19 to the rim 2 by means of the sealing tool 21.

Figure 6:
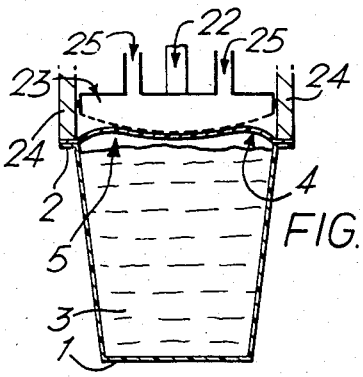
FIG. 6 is a sectional view of a filled container and a second head with its outer rim located on the container rim and FIG. 7 is a sectional view of a filled container with the lower part of a third head after descent.
Figure 7:
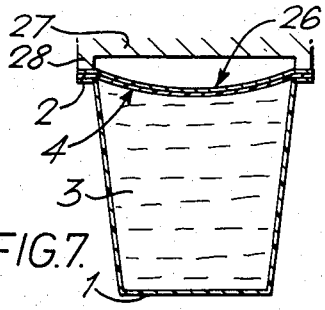

A third embodiment of this invention will now be described with reference to FIGS. 1, 6 and 7.

A thermoplastic based container 1 with a rim 2 comprises a food product 3, an intermediate microporous polypropylene membrane 4 and a headspace 5. A first head 6 is fitted with a sealing tool 7. A second head 22 comprises an inner piston 23, a sealing tool 24 and channels 25. A second pre-formed foil membrane 26 lies on top of the container 1 beneath a third head 27 fitted with a sealing tool 28.

In operation, the container 1 is initially positioned beneath the first head 6 where the intermediate microporous polypropylene membrane 4 is sealed to the rim 2 in the conventional manner by the sealing tool 7 to confer the normal volume of headspace 5. Afterwards the first head is removed and the container is moved to the second head 22 which is brought into a position so that it is located on the rim 2. The gas is extracted from the headspace by vacuum suction through the channels 25 and simultaneously the inner piston 23 descends to deform the intermediate membrane 4 until it touches the food product 3. During this operation the location of the head 22 on the container rim 2 restricts the suction to the area immediately above the container. After the gas has been extracted from the headspace, nitrogen is injected through the channels 25 to return the system to atmospheric pressure. Finally the container is moved to the third head 27 which descends to seal the second pre-formed foil membrane 26 to the rim 2 by means of the sealing tool 28.

I claim:

1. A process for sealing a thermoplastic container having structure defining an opening at the top of the container and a rim surrounding said opening, there being a food product disposed within said container, said process comprising the steps of:

(a) sealing a microporous gas-permeable intermediate membrane to said rim so that said intermediate membrane covers said opening, there is a headspace between the intermediate membrane and the food product and there is a gas within such headspace, (b) extracting said gas from the headspace by deforming the intermediate membrane into the headspace towards the food product to thereby reduce the volume of the headspace and force the gas out of the headspace through the intermediate membrane, and (c) sealing a barrier membrane to the rim so that the sealed barrier membrane is superposed on the intermediate membrane and overlies said opening, said intermediate membrane retaining the food product within the container during the gas-extracting step to thereby prevent contamination of said rim by said food product during such step.

2. A process according to claim 1 characterised in that after the gas has been extracted from the headspace and before the container is sealed by the barrier membrane, inert gas is flushed back into the headspace to restore the original headspace volume.

3. A process according to claim 1 characterised in that the intermediate membrane is made of polypropylene.

4. A process according to claim 1 characterised in that the porosity to air at atmospheric pressure of the intermediate membrane is from 1,000 cc/min. to 2,000 cc/min.

5. A process according to claim 1 characterised in that the gas is extracted from the headspace by both mechanically deforming the intermediate membrane into the headspace and simultaneously using vacuum suction.

6. A process according to claim 5 characterised in that after the gas has been extracted from the headspace and before the container is sealed by the barrier membrane, inert gas is flushed back into the headspace to restore the original headspace volume, the vacuum suction and the gas flush being carried out by means of a suction head positioned over the container such head having a rim, the rim of the head engaging the rim of the container.

7. A process as claimed in claim 1 characterised in that the intermediate membrane is deformed by disposing the container beneath a piston having a convex face so that said piston is aligned with the opening in the container and advancing said piston downwardly so that the convex face of the piston engages and deforms the intermediate membrane.

8. A process as claimed in claim 1 characterised in that said barrier membrane is disposed between said piston and said intermediate membrane when the piston is advanced.

9. A process as claimed in claim 8 characterised in that the barrier membrane is retained on the convex face of said piston in conforming relation therewith while the piston is advanced.

10. A process as claimed in claim 1 characterised in that the intermediate membrane is deformed to such an extent that such membrane contacts the food product.

11. A process according to claim 1 further comprising the step of heat-processing the container and the food product contained therein after step (a) and before step (c), without applying an overpressure during the heat-processing step.

* * * * *

UNITED STATES PATENT AND TRADEMARK OFFICE

CERTIFICATE OF CORRECTION

PATENT NO. : 4,513,015
DATED : April 23, 1985
INVENTOR(S) : Graham Clough

It is certified that error appears in the above—identified patent and that said Letters Patent is hereby corrected as shown below:

On the title page;

In the abstract, line 2, "characterized" should read --characterised--.

Column 2, line 19, "specially" should read --especially--.

Claim 1, subpart (a), after "food product" insert --,--.

Claim 8, line 1, "claimed in claim 1" should read --claimed in claim 7--.

Signed and Sealed this

*Twentieth* Day of *August 1985*

[SEAL]

*Attest:*

DONALD J. QUIGG

*Attesting Officer* *Acting Commissioner of Patents and Trademarks*